US006650760B1

(12) United States Patent
Andrews et al.

(10) Patent No.: US 6,650,760 B1
(45) Date of Patent: Nov. 18, 2003

(54) LOUDSPEAKER

(75) Inventors: Anthony J Andrews, Dorking (GB); Toby C. C. Hunt, Rusper (GB); John Newsham, Dorking (GB)

(73) Assignee: Funktion One (GB)

( * ) Notice: Subject to any disclaimer, the term of this patent is extended or adjusted under 35 U.S.C. 154(b) by 96 days.

(21) Appl. No.: 09/607,393

(22) Filed: Jun. 30, 2000

(30) Foreign Application Priority Data

Jul. 14, 1999 (GB) ..... 9916380

(51) Int. Cl.[7] ..... H04R 25/00

(52) U.S. Cl. ..... 381/343; 381/340; 381/337; 381/339; 181/152

(58) Field of Search ..... 381/337, 338, 381/339, 340, 343; 181/177, 179, 185, 187, 189, 192, 196, 152

(56) References Cited

U.S. PATENT DOCUMENTS 1,485,348 A * 2/1924 Johnson ..... 181/185
2,761,913 A * 9/1956 Manley et al. ..... 181/187
2,808,895 A * 10/1957 Chave ..... 181/171
2,836,664 A * 5/1958 Manley et al. ..... 381/186
4,091,891 A * 5/1978 Hino et al. ..... 181/185
4,157,741 A * 6/1979 Goldwater ..... 181/156
4,310,065 A * 1/1982 Kayman ..... 181/159
4,378,471 A * 3/1983 Shintaku ..... 181/177
4,390,078 A * 6/1983 Howze et al. ..... 181/185
RE32,183 E * 6/1986 Isaacs ..... 181/159
4,776,428 A * 10/1988 Belisle ..... 181/152
4,836,327 A * 6/1989 Andrews et al. ..... 181/145
4,975,965 A * 12/1990 Adamson ..... 181/159
5,163,167 A * 11/1992 Heil ..... 181/152
5,526,456 A * 6/1996 Heinz ..... 181/152
6,026,928 A * 2/2000 Maharaj ..... 181/152
6,028,947 A * 2/2000 Faraone et al. ..... 181/152
6,094,495 A * 7/2000 Rocha ..... 181/152
6,343,133 B1 * 1/2002 Adamson ..... 181/152

* cited by examiner

*Primary Examiner*—Curtis Kuntz
*Assistant Examiner*—P. Dabney
(74) *Attorney, Agent, or Firm*—Andrus, Sceales, Starke & Sawall

(57) ABSTRACT

An upper base/low mid loudspeaker comprises a conical driver and a channel defined by a housing and a central member. The central member has a portion extending into the cone to form a first generally ring-shaped region whose cross-sectional area increases in the direction of sound propagation. A second generally ring-shaped region is defined between a portion of the housing and a portion of the central member. The cross-sectional area of the second region decreases in the direction of sound propagation. The channel continues with a throat and a horn.

12 Claims, 4 Drawing Sheets

LOUDSPEAKER

The present invention relates to a loudspeaker. In particular, the invention relates to a loudspeaker of the upper bass/low mid type which may be used with loudspeakers covering other parts of the audible sound frequency spectrum in high quality public address (PA) systems.

The range or spectrum of audible sound frequencies is generally taken to extend from about 15 Hz to about 20 KHz. It is well known to divide this frequency range into several notional contiguous ranges with each such range being catered for by a loudspeaker whose design is largely dictated by the sub-range which it is required to handle. A typical example of such sub-ranges is as follows:

| | |
|---|---|
| Bass | 35–175 Hz |
| Low Mid | 175–1600 Hz |
| High Mid | 1600–5000 Hz |
| Treble | 5000–18000 Hz |

It has been found that the sub-ranges into which large PA systems are divided do not represent the best division of acoustic energy. Even in the best "four way" systems (i.e. systems having four sub-ranges), there is usually a "muddy" and ill-defined frequency area straddling the used 150–200 Hz cross-over point between the bass and low mid sub-ranges. This unsatisfactory area extends from about 120 Hz to about 350 Hz.

According to a first aspect of the invention, there is provided an upper bass/low mid loudspeaker comprising: an electro-acoustic driver having a conical diaphragm and a housing and a central member defining a channel for the propagation of sound from the front of the diaphragm, the central member having a first portion extending into the volume defined by the diaphragm and defining with the diaphragm a first region of the channel of ring-shaped cross-section whose transverse cross-sectional area increases in the direction of sound propagation within the channel, the central member having a second portion disposed within a first portion of the housing to define a second region of the channel of ring-shaped cross-section whose transverse cross-sectional area decreases in the direction of sound propagation within the channel, the housing having a second portion defining a throat extending from the second region and a third portion defining a horn extending from the throat.

The first portion of the central member may have a transverse cross-sectional area which increases in the direction of sound propagation within the channel and the second portion of the central member may have a transverse cross-sectional area which decreases in the direction of sound propagation within the channel.

The throat may have a transverse cross-sectional area which increases at a first rate in the direction of sound propagation of sound within the channel. The horn may have a transverse cross-sectional area which increases at a second rate greater than the first rate in the direction of sound propagation within the channel.

The central member may have a third portion extending within the second portion of the housing and defining therebetween the throat which is of ring-shaped transverse cross-section. The central member may have a fourth portion extending into the horn. The fourth portion of the central member may have a substantially hemispherical end.

The central member may have a substantially circular transverse cross-sectional shape throughout its extent in the direction of sound propagation within the channel.

The housing may have a substantially rectangular transverse cross-sectional shape throughout its extent in the direction of sound propagation within the channel.

The housing may have a substantially parallel pair of internal surfaces.

The channel may be folded, for example at or adjacent the transition between the second region and the throat.

The loudspeaker may comprise an enclosure at the rear of the driver forming therewith a substantially sealed chamber.

According to a second aspect of the invention, there is provided a PA system including a loudspeaker according to the first aspect of the invention.

The term "ring-shaped" as used herein means annular or isomorphic thereto. Thus, the central member is disposed inside the housing but does not touch it so that, at each cross-section transverse to the direction of sound propagation within the channel, the housing is spaced from the central member all the way around the central member.

The term "transverse cross-section" as used herein means a section in a plane which is substantially perpendicular to the local direction of sound propagation within the channel.

It is thus possible to provide an upper bass/low mid loudspeaker which is capable of covering up to about a decade, for example from about 75 Hz to about 750 Hz. Within the upper bass/lower middle range of frequencies, a smooth frequency response, fast transient response and high efficiency (large acoustic output per watt of electrical power) can be provided. Furthermore, a good dispersion pattern, for example in the horizontal plane, can be provided. Such a loudspeaker is suitable for use in PA system, for example for concerts where high quality high level sound is required.

The unsatisfactory sound quality of known systems having a cross-over point around 150–200 Hz as mentioned hereinbefore can thus be overcome by providing an upper bass/low mid speaker with a range such that the cross-over points are well outside the troublesome area of 120–350 Hz. This allows a high quality PA system with a greatly improved division of acoustic energy and hence sound quality to be provided.

The invention will be further described, by way of example, with reference to the accompanying drawings, in which.

Like reference numerals refer to like parts throughout the drawings.

Figure 1:
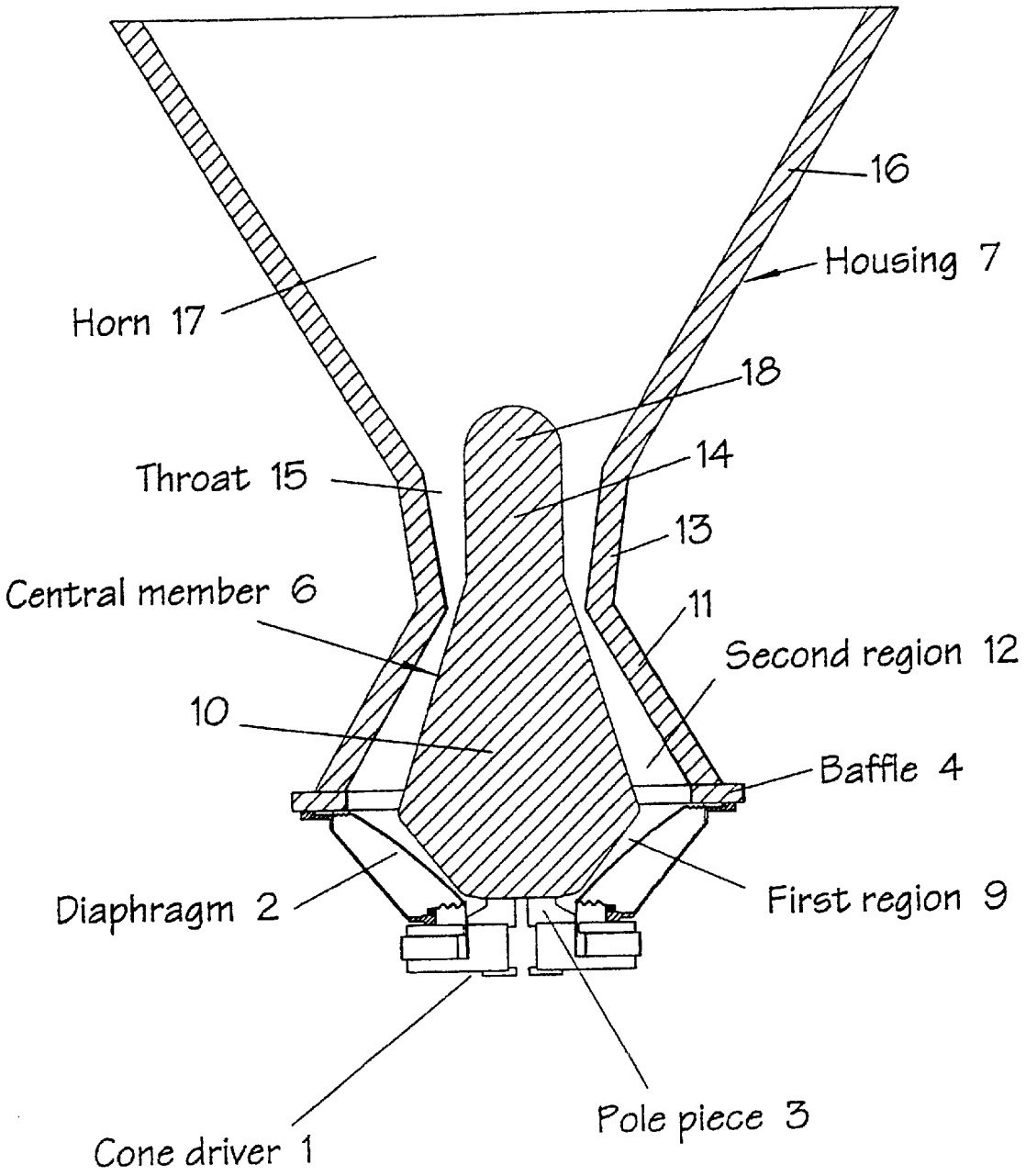
FIG. 1 is a horizontal cross-sectional view of a loudspeaker constituting a first embodiment of the invention.
Figure 2:
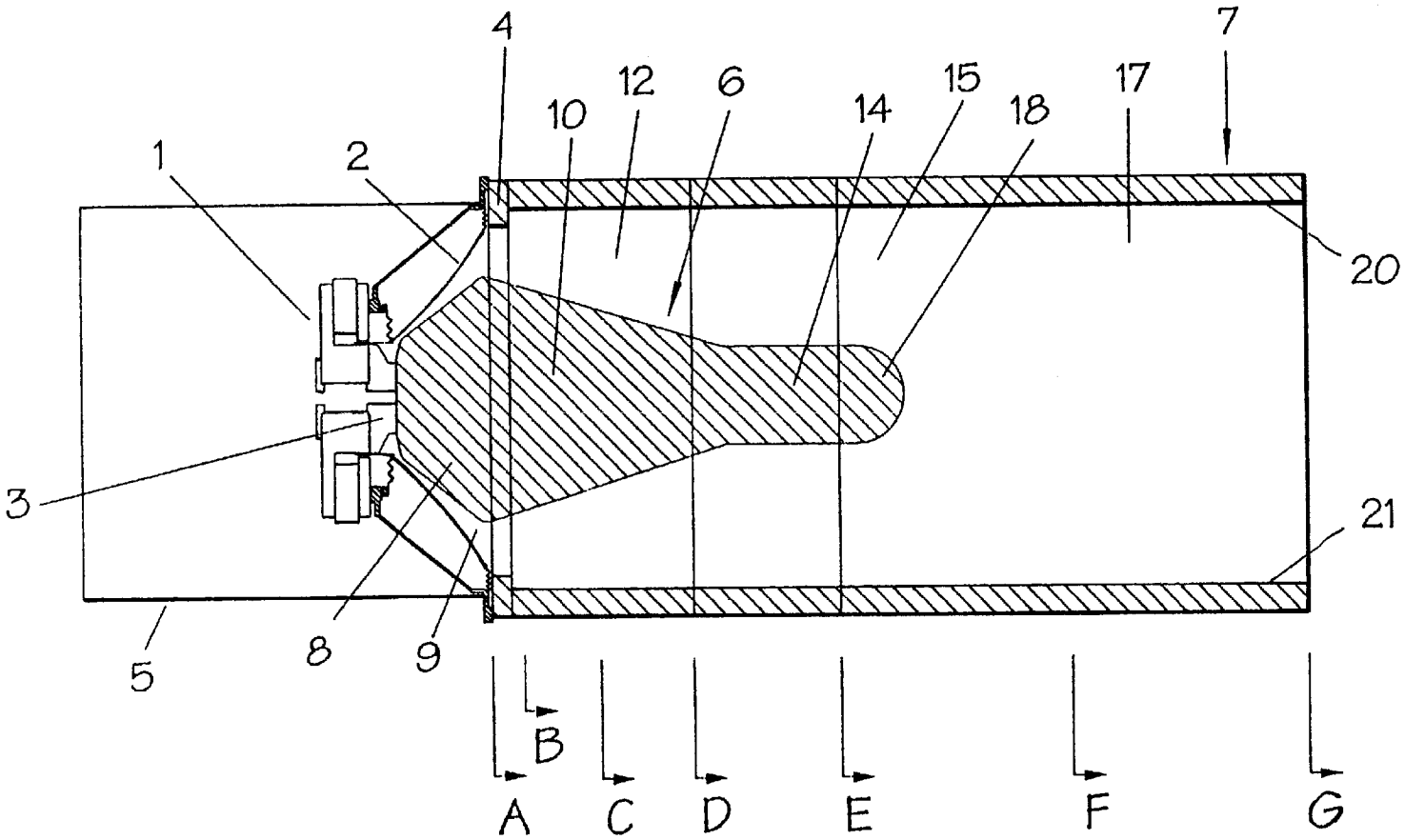
FIG. 2 is a vertical cross-sectional view of the loudspeaker of FIG. 1.
Figure 3:
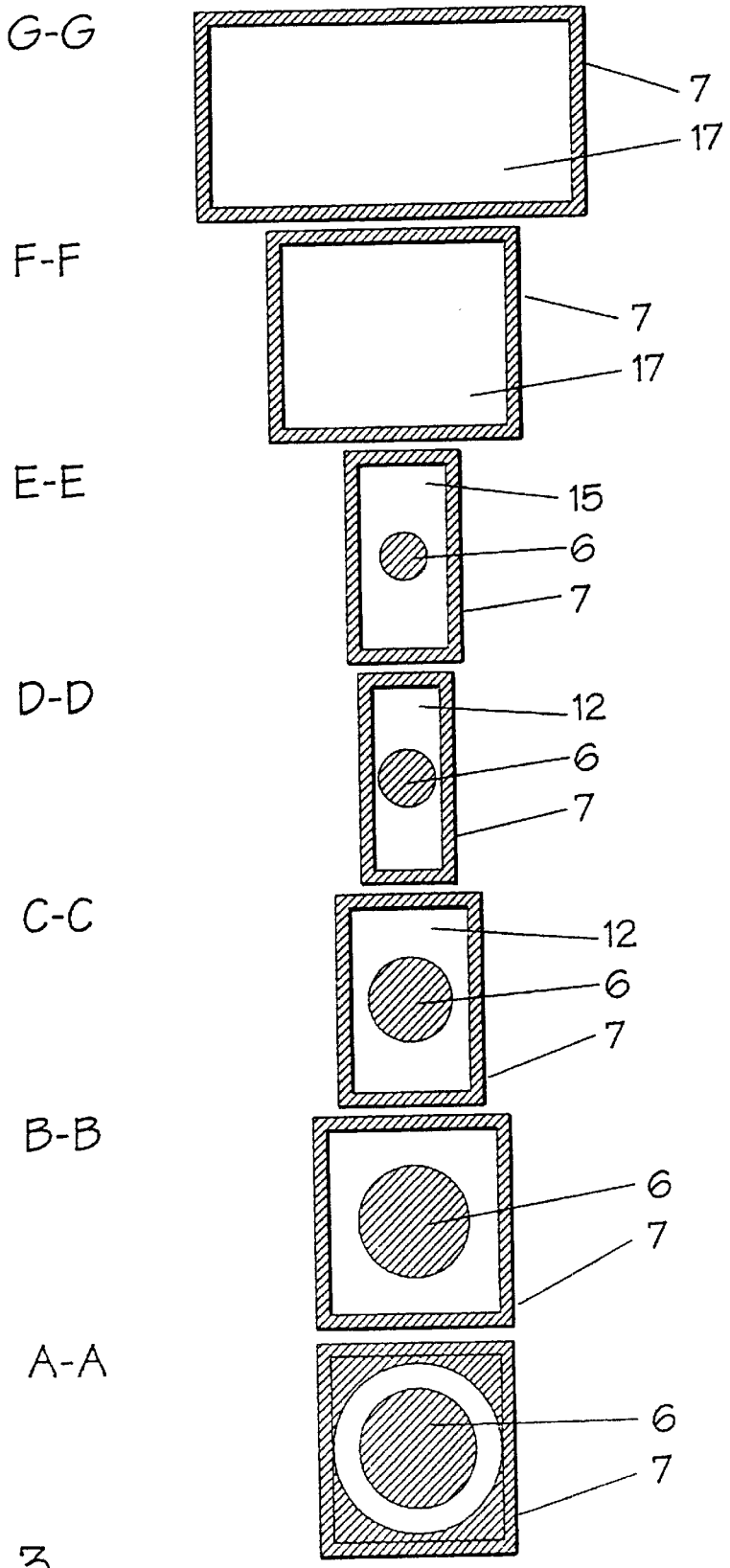
FIG. 3 shows transverse cross-sections taken at different points along the direction of propagation as illustrated in FIG. 2.

The loudspeaker shown in FIGS. 1 to 3 is for use at upper bass/low mid frequencies, for example as part of a loudspeaker system of a PA system. The loudspeaker comprises a cone driver 1. The driver 1 comprises a conical diaphragm 2 and a magnet structure with a central pole piece 3. The front of the driver chassis is mounted on a baffle 4 and an enclosure illustrated diagrammatically at 5 in FIG. 2 is disposed behind the driver 1 and attached to the baffle 4 so as to form a sealed chamber behind the driver 1.

The loudspeaker comprises a central member 6 and housing 7 which define a channel for propagation of sound from the front of the diaphragm 2 to the exterior of the housing 7. The central member 6 is of circular transverse cross-section throughout its length and is attached at its rear to the pole piece 3. The central member 6 has a first portion 8 which extends into the conical volume defined by the diaphragm 2. The first portion 8 and the diaphragm 2 define a first region 9 of the channel of annular transverse cross-sectional shape. The transverse cross-sectional area of the first region 9 increases in the direction of sound propagation within the channel i.e. from the pole piece 3 approximately to the plane of the baffle 4. Similarly, the transverse cross-sectional area of the first portion 8 increases in the direction of sound propagation.

The central member 6 has a second portion 10 whose transverse cross-sectional area decreases in the direction of sound propagation. The second portion 10 is disposed centrally inside a first portion 11 of the housing 7 and defines therewith a ring-shaped second region 12 of the channel whose transverse cross-sectional area decreases in the direction of sound propagation.

The housing 7 has a second portion 13 which cooperates with a third portion 14 of the central member 6 to define a throat 15 which extends from the second region 12. The housing 7 has a third portion 16 which defines a horn 17 extending from the throat 15. The central member 6 has a fourth portion 18 of substantially hemispherical shape which projects into the start of the horn 17.

The central member 6 is circularly symmetrical about the longitudinal axis of the loudspeaker (coaxial with the direction of sound propagation within the channel). Thus, the transverse cross-sectional shape of the central member 6 is circular throughout its length.

The throat 15 has a transverse cross-sectional area which increases at a first rate in the direction of propagation. The horn 17 has a transverse cross-sectional area which increases, in the direction of propagation, at a second rate which is greater than the first rate: The transverse cross-sectional area of the third portion 14 of the central member 6 is substantially constant throughout the throat 15 or most thereof.

As shown in FIG. 2, the housing 7 comprises upper and lower surfaces 20 and 21 which are substantially parallel and, in use, are disposed in parallel horizontal planes. The transverse cross-sectional shapes of the channel are illustrated in FIG. 3 at various positions (labelled A to G in FIG. 2) along the length of the loudspeaker from the plane of the baffle (A) to the plane of the mouth (G) of the horn 17. The varying circular cross-section of the central member 6 is clearly shown in cross-sections A—A to E—E. Forward of the baffle 10, the housing 7 is of rectangular cross-section with the width varying throughout the length of the loudspeaker but with the height being substantially constant. The channel is therefore ring-shaped in transverse section throughout its length to the end of the hemispherical fourth portion 18 of the central member 6.

A loudspeaker of the type shown in FIGS. 1 to 3 is capable of operating over approximately a decade from about 75 to about 750 Hz. Although the mechanism is not fully understood, it is believed that a function of the central member 6 is to maintain coherence in the upper part of the frequency spectrum of the loudspeaker and to move upwardly the whole frequency band of which the loudspeaker would be capable in the absence of the central member 6. It is also believed that the "constriction" which occurs in the second region 12 just before the throat 15 compensates for the loss of low frequencies caused by the central member 6 by lowering the low frequency cut-off-point of the loudspeaker. It is believed that, typically in the absence of the constriction, the lower end of the frequency range would be about 150 to 200 Hz. However, the presence of the constriction lowers this to about 75 Hz. The combined effect is to provide a loudspeaker having excellent coherence across a large frequency band.

The loudspeaker provides very high output levels with high electro-acoustic efficiency, typically giving an acoustic output of 107 dB at one meter for an electrical input of one watt. Also, a wide and uniform dispersion pattern in the horizontal plane can be provided, as is typically required of PA systems. The loudspeaker has a smooth frequency response within its operating range and a fast transient response. All of these features make the loudspeaker suitable for use in very high quality PA systems.

The loudspeaker shown in FIG. 1 has an essentially straight acoustic channel within which the sound propagates from the diaphragm 2 to the exterior. Such a loudspeaker occupies a substantial area in the horizontal plane. However, as shown in FIG. 4, it is possible to provide a more compact loudspeaker of a type similar to that in FIG. 1 by folding the channel.

Figure 4:
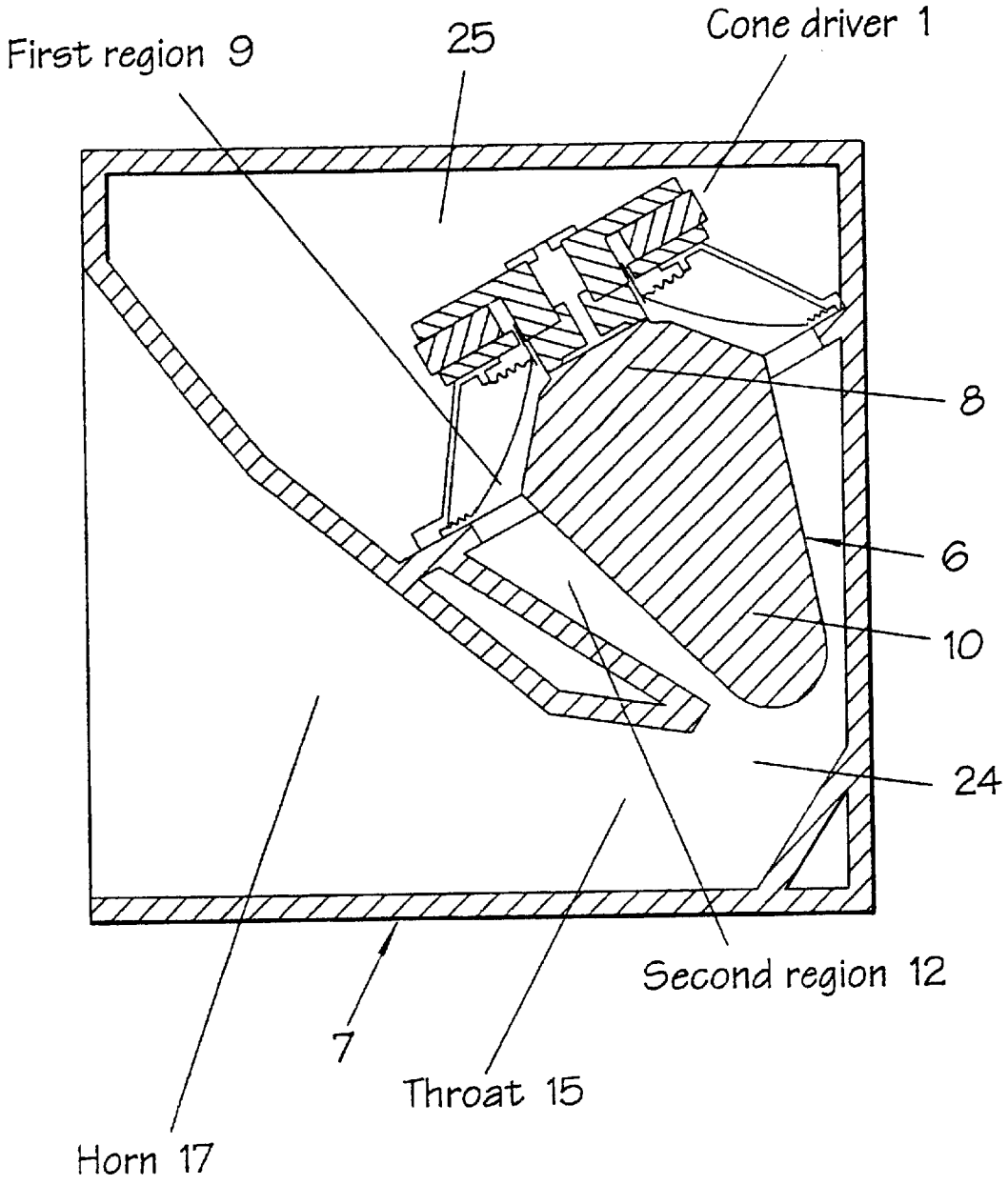
FIG. 4 is a horizontal cross-sectional view of a loudspeaker constituting a second embodiment of the invention.

The loudspeaker shown in FIG. 4 differs from that shown in FIG. 1 in two essential ways. The acoustic channel is bent around a vertical axis at or near the transition 24 between the second region 12 and the throat 15. Also, the central member 6 comprises only the first and second portions 8 and 10.

The height of the housing 7 is substantially constant and the whole loudspeaker is contained between parallel upper and lower walls. Thus, the loudspeaker shown in FIG. 4 is acoustically similar to that shown in FIG. 1 but occupies substantially less space.

FIG. 4 also illustrates the sealed chamber 25 acting as an enclosure behind the driver 1.

What is claimed is:

1. An upper bass/low mid loudspeaker comprising: an electro-acoustic driver having a conical diaphragm; and a housing and a central member defining therebetween a single channel for propagation of sound from a front of said diaphragm, said central member having a first portion extending into a volume defined by said diaphragm and defining with said diaphragm a first region of said channel of ring-shaped cross-section having a transverse cross-sectional area which increases in a direction of sound propagation within said channel, said central member having a second portion disposed within a first portion of said housing to define a second region of said channel of ring-shaped cross-section having a transverse cross-sectional area which decreases in said direction of sound propagation within said channel, said housing having a second portion defining a throat extending from said second region and a third portion defining a horn extending from said throat.

2. A loudspeaker as claimed in claim 1, in which said first portion of said central member has a transverse cross-sectional area which increases in said direction of sound propagation within said channel and said second portion of said central member has a transverse cross-sectional area which decreases in said direction of sound propagation within said channel.

3. A loudspeaker as claimed in claim 1, in which said throat has a transverse cross-sectional area which increases at a first rate in said direction of sound propagation within the channel.

4. A loudspeaker as claimed in claim 3, in which said horn has a transverse cross-sectional area which increases at a second rate greater than said first rate in said direction of sound propagation within said channel.

5. A loudspeaker as claimed in claim 1, in which said central member has a fourth portion extending into said horn.

6. A loudspeaker as claimed in claim 5, in which said fourth portion of said central member has a substantially hemispherical end.

7. A loudspeaker as claimed in claim 1, in which said central member has a substantially circular transverse cross-sectional shape throughout its extent in said direction of sound propagation within said channel.

8. A loudspeaker as claimed in claim 1, in which said housing has a substantially rectangular transverse cross-sectional shape throughout its extent in said direction of sound propagation within said channel.

9. A loudspeaker as claimed in claim 1, in which said housing has a substantially parallel pair of internal surfaces.

10. A loudspeaker as claimed in claim 1, in which said channel is folded.

11. A loudspeaker as claimed in claim 10, in which said channel is folded at or adjacent said transition between said second region and said throat.

12. A loudspeaker as claimed in claim 1, comprising an enclosure at a rear of said driver defining therewith a substantially sealed chamber.

* * * * *